United States Patent [19]

Longsworth

[11] Patent Number: 4,606,201

[45] Date of Patent: Aug. 19, 1986

[54] DUAL THERMAL COUPLING

[75] Inventor: Ralph C. Longsworth, Allentown, Pa.

[73] Assignee: Air Products and Chemicals, Inc., Allentown, Pa.

[21] Appl. No.: 789,004

[22] Filed: Oct. 18, 1985

[51] Int. Cl.[4] ..... F25B 19/00

[52] U.S. Cl. ..... 62/514 JT; 62/45; 62/55.5

[58] Field of Search ..... 62/55.5, 45, 514 R, 62/514 JT

[56] References Cited

U.S. PATENT DOCUMENTS

| | | | |
|---|---|---|---|
| 3,620,029 | 11/1971 | Longsworth | 62/6 |
| 4,206,760 | 6/1980 | Davis | 62/514 JT |
| 4,223,540 | 9/1980 | Longsworth | 62/514 |
| 4,484,458 | 11/1984 | Longsworth | 62/514 |
| 4,514,204 | 4/1985 | Bonney et al. | 62/41 |

OTHER PUBLICATIONS

Cryogenic Fluid Storage Vessels; R. Barron, McGraw Hill, 1966; p. 448 IEEE Magnetics, Jan. 1979, pp. 848, 219.

*Primary Examiner*—Ronald C. Capossela

*Attorney, Agent, or Firm*—James C. Simmons; E. Eugene Innis

[57] ABSTRACT

Enhanced thermal contact between axially aligned heat stations on a refrigerator and axially aligned heat stations on a device to be cooled wherein at least one of said heat stations on said device being cooled is allowed to move or float axially relative to the other heat station on said device being cooled to accommodate thermal contraction.

20 Claims, 1 Drawing Figure

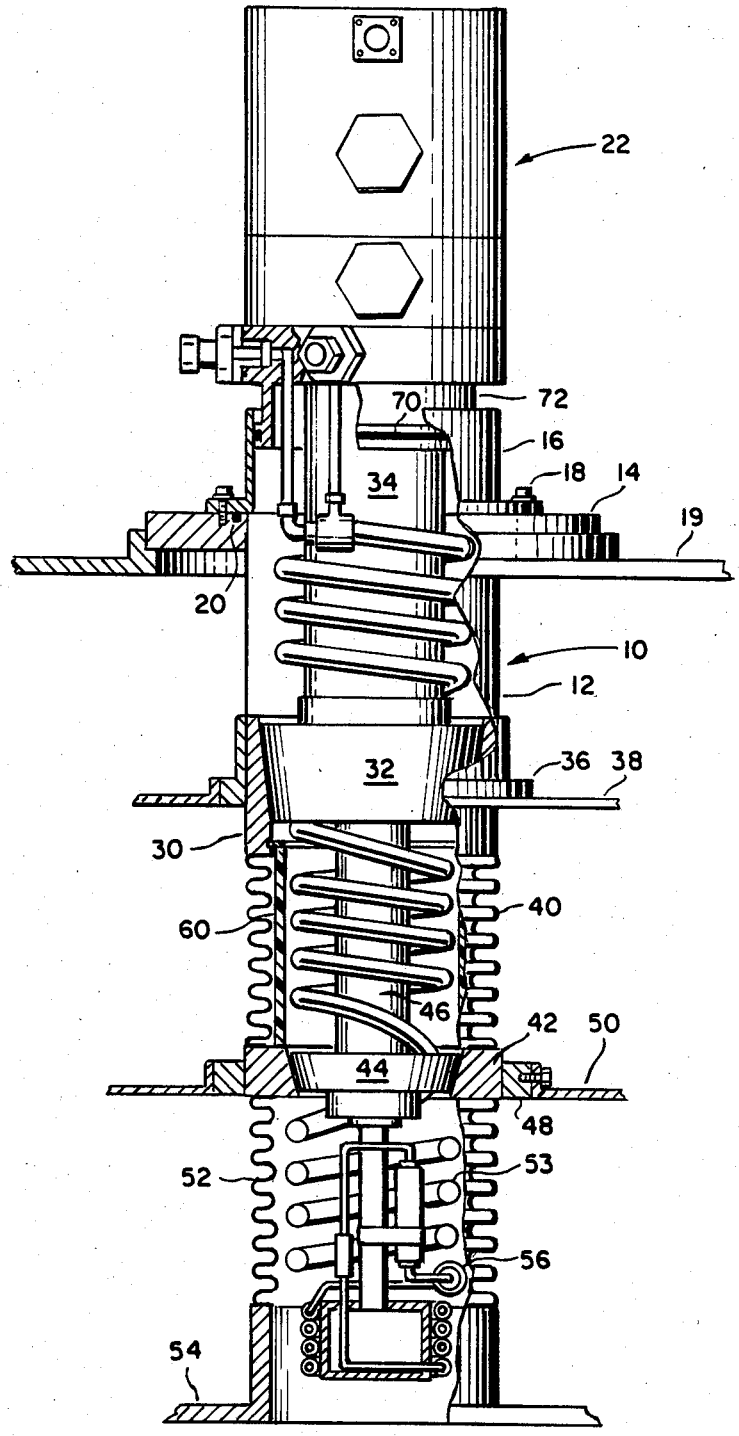
22
72
70
16
18
14
34
19
20
10
12
32
36
38
30
40
60
46
42
50
44
48
52
53
56
54

DUAL THERMAL COUPLING

BACKGROUND OF THE INVENTION

This invention pertains to thermal contact between axially aligned heat stations on a refrigerator and corresponding axially aligned heat stations on a device to be cooled by the refrigerator.

BACKGROUND OF THE PRIOR ART

The multi-stage refrigerator such as shown in U.S. Pat. No. 3,620,029 provides for the production of refrigeration at a first and a second stage of a two stage refrigerator or each stage of a multi-stage refrigerator having stages beyond two. Such devices can be used in combination with a Joule-Thompson refrigeration loop to recondense liquid helium and cool intermediate radiation shields in a helium cryostat such as shown in U.S. Pat. No. 4,223,540. In U.S. Pat. No. 4,223,540 a two-stage refrigerator with a 4 Kelvin (K.) Joule-Thompson loop is mounted in the neck tube of a helium cryostat where it cools radiation shields at 77 K. and 20 K. and recondenses the helium. The refrigeration is coldest starting with the Joule-Thompson loop and ending with the first stage. The refrigerator is slideably fitted in the neck tube so it can be removed for service. Conventional close clearance thermal couplings have a large thermal gradient ($\Delta T$) associated with them so that better mechanical contact is sought. Sliding frictional contact such as shown in conjunction with a cryopump in U.S. Pat. No. 4,514,204 is one method of transferring refrigeration from the refrigerator to a heat station for transfer to the cryopanels.

U.S. Pat. No. 4,484,458 discloses and claims a refrigerator for condensing helium in a confined space which refrigerator is suitable for the apparatus of the instant invention, the specification of U.S. Pat. No. 4,484,458 being incorporated herein by reference.

The problem of accessing the cryogenic fluid in a dewar or storage vessel by means of flexible bellows in the neck tube to compensate for thermal contraction when liquid helium at 4 K. is inside the dewar and the ambient temperature is +300 K. are shown in the publication Cryogenic Systems by R. Baron (McGraw-Hill 1966) at page 448 and the articles by S. J. St. Lorant and D. L. Jassby, et al. appearing in the January 1979 edition of *IEEE Transaction on Magnetics,* Vol. MAG-15 No. 1.

SUMMARY OF THE INVENTION

In order to provide for intimate thermal contact between axially spaced heat stations on a refrigerator and axially spaced heat stations on a device to be cooled, each having complimentary surfaces it has been discovered that a first heat station on the device to be cooled can be mounted on a generally cylindrical sleeve which sleeve can be positioned relative to the opening in a receptacle for receiving a first heat station of said refrigerator. A second generally cylindrical flexible sleeve can be axially aligned with the first sleeve, the second sleeve adapted to position a second heat station to mate with the second heat station on the refrigerator. The flexible bellows is being used to compensate for axial dimensional tolerances and for thermal contraction as the refrigerator heat station is mated to the heat stations on the device to be cooled and the temperature is equalized.

BRIEF DESCRIPTION OF THE DRAWING

The single FIGURE of the drawing is a front elevational view partially in section illustrating the apparatus of the present invention.

DETAILED DESCRIPTION OF THE PREFERRED EMBODIMENT

Referring to the drawing, the apparatus of the present invention 10 includes a first sleeve 12 which sleeve 12 is adapted by means of a plate 14 to be fixed to the access or the neck 16 of a vacuum jacketed helium storage receptacle (dewar) 19 such as shown in U.S. Pat. No. 4,223,540, the specification of which is incorporated herein by reference. Sleeve 12 can be fabricated from a thin walled rigid tube as shown in the drawing. Alternatively, sleeve 12 can be a flexible bellows. In either case, stainless steel is a preferred material of construction. Neck 16 is fixed to base plate 14 in fluid tight relation by means of a plurality of bolts 18 and a sealing device such as O-ring 20 which is disposed in a groove in base plate 14. Neck 16 is adapted to receive a cryogenic refrigerator 22 for slideable movement within the neck 16 as will hereinafter be more fully described. Refrigerator 22 can be identical to that shown and described in U.S. Pat. No. 4,484,458.

Referring back to the apparatus 10, disposed at the bottom of sleeve 12 is a first heat station 30 fixed to the sleeve 12 as by brazing. Heat station 30 is of generally cylindrical cross section having a tapered inside surface which is a complimentary shape to refrigerator heat station 32 which is fixed to the first stage 34 of refrigerator 22. Disposed around sleeve 12 in intimate contact with heat station 30 is an adaptor 36 for a device to be cooled by the refrigeration of the first stage such as a heat shield 38 of a vacuum jacketed storage receptacle (vessel) referred to above. Depending from the heat station 30 is a second or flexible sleeve 40 which spaces a second heat station 42 axially from the first heat station 30. The flexible sleeve 40 is preferably a metallic bellows preferably fabricated from a poor thermal conductor such as stainless steel. The second heat station 42 is also generally cylindrical in shape and is adapted to have an internal surface which is complimentary to the outside surface of second refrigerator heat station 44 associated with the second stage 46 of refrigerator 22 to transfer refrigeration from the second stage 46 of the refrigerator 22 to an adaptor 48 which in turn can transfer the refrigeration to object to be cooled such as second radiation shield 50 of the dewar 19. Depending from and in intimate thermal contact with the second heat station 42 is a second flexible sleeve 52 which is adapted to be mounted to the inner vessel 54 of the dewar 19 which inner vessel 54 contains the liquid helium. The second flexible sleeve which is also a metal bellows of poor thermal conductivity (e.g. fabricated from stainless steel) is adapted to surround the Joule-Thompson loop 53 of the refrigerator 22. Disposed within the first bellows 40 is a non-metallic sleeve 60 which is generally rigid and which can be used to prevent radial movement of the heat station 42.

Refrigerator 22 has a first stage 34 which produces refrigeration at about 77° K., a second stage 46 which produces refrigeration at about 20° K. and liquid helium in the orifice of the Joule-Thompson loop 56 at 4° K. Such devices can be used for nuclear magnetic resonance devices to cool the superconducting magnets. In such a device it is necessary to remove the refrigerator 22 periodically to service it. In the device of the present invention, the adaptor 10 is fixed in fluid-tight relation to the neck 16 of the dewar 19 as described above. The refrigerator 22 can then be disposed within the apparatus 10 and a seal effected by means of a groove and "O"-ring 70 in the refrigerator adaptor 72. This assures a gas tight seal between the refrigerator and the neck 16 of dewar 19. As the refrigerator 22 is inserted in the apparatus 10 the second heat station 44 of refrigerator 10 contacts second heat station 42 and extends the first or upper flexible sleeve or bellows 40 and compresses the second or lower bellows 52 until contact is made between the heat station 32 of refrigerator 22 and heat station 30 of apparatus 10. This assures intimate contact between the refrigerator heat stations and the heat stations of apparatus 10. Due to the apparatus 10 being fixed in fluid-tight relationship to the inner vessel 54 of the dewar, helium trapped between the refrigerator 22 and the adaptor 10 is sealed therein for use as a heat transfer fluid.

With a device according to the present invention, the thermal gradient between the heat stations on the source of refrigeration and the heat stations to be cooled is virtually nil since there is intimate thermal contact due to mechanical contact and gas conduction.

If a two-stage refrigerator, one without the Joule-Thompson loop, were to be used to transfer refrigeration between the first and second stage of the refrigerator and devices to be cooled, then of course the second or lower flexible sleeve or bellows 52 would not be needed and the apparatus would terminate at the second heat station 42 which would be attached to the second object to be cooled by means of a flexible conductive strap.

As set out above with the device of the present invention the refrigerator 22 can be readily removed from the helium dewar for servicing without excessive loss of helium and with assurance that when the refrigerator is returned to service refrigeration would be transferred effectively between the various stages of the refrigerator and the associated devices in the dewar.

Having thus described my invention what is desired to be secured by Letters Patent of the United States is set forth in the appended claims.

I Claim:

1. An apparatus to be cooled by a refrigerator having fixed axially spaced first and second heat stations comprising in combination:

a first generally cylindrical sleeve adapted to position a first heat station, said first heat station adapted to mate in close physical contact with a first heat station on said refrigerator inserted in said apparatus;

a second generally cylindrical flexible sleeve axially aligned with said first sleeve and said first heat station, said second generally flexible sleeve adapted to position a second heat station spaced axially from said first heat station and to mate in close physical contact with a said second heat station on said refrigerator; whereby when said refrigerator is inserted inside said axially aligned sleeves said second heat station can be moved relative to said first heat station by said refrigerator to provide thermal contact between said first refrigerator heat station and said first heat station on said apparatus and said second refrigerator heat station and said second heat station on said apparatus.

2. An apparatus according to claim 1 wherein a third generally cylindrical flexible sleeve is axially aligned with said second sleeve and fixed to said second heat station so that it is more remote from said first heat station than said second flexible sleeve.

3. An apparatus according to claim 2 wherein said second and third generally flexible sleeve are metal bellows.

4. An apparatus according to claim 3 wherein said metal bellows are fabricated from stainless steel.

5. An apparatus secondly to claim 1 wherein said second flexible sleeve is a metal bellows.

6. An apparatus according to claim 5 wherein said metal bellows is fabricated from stainless steel.

7. An apparatus according to claim 1 wherein said first and second heat stations on said refrigerator are conductive generally cylindrical tapered plugs fixed to said refrigerator.

8. An apparatus according to claim 1 wherein said first and second heat stations are generally cylindrical highly conductive members having internally tapered surfaces tapered negatively in a direction marked from the position of said first cylindrical sleeve.

9. An apparatus according to claim 1 wherein said refrigerator is a two stage cryogenic refrigerator having axially aligned refrigeration stages.

10. An apparatus according to claim 1 wherein said apparatus is fixed to a vacuum jacketed reservoir.

11. An apparatus for receiving a two stage cryogenic refrigerator having axially aligned first and second refrigeration stages to provide at least two levels of refrigeration inside said apparatus comprising in combination:

a first generally cylindrical sleeve, said sleeve adapted to position a first heat station relative to and in intimate thermal contact with said first stage of said refrigerator; and a second generally cylindrical flexible sleeve axially aligned with said first sleeve said second sleeve adjusted to position a second heat station in intimate thermal contact with said second stage of said cryogenic refrigerator.

12. An apparatus according to claim 11 wherein a third generally cylindrical flexible sleeve is adapted for positioning between said second heat station and a reservoir of liquid cryogen in a receptacle to which the apparatus is fixed.

13. An apparatus according to claim 12 wherein said refrigerator has a Joule-thompson heat exchanger depending from said second stage said heat exchanger positioned inside said third sleeve when said refrigerator is disposed within said apparatus.

14. An apparatus according to claim 12 wherein said second and third generally flexible sleeves are metal bellows.

15. An apparatus according to claim 14 wherein said metal bellows are fabricated from stainless steel.

16. An apparatus according to claim 11 wherein said flexible sleeve is a metal bellows.

17. An apparatus according to claim 16 wherein said metal bellows is fabricated from stainless steel.

18. An apparatus according to claim 11 wherein first and second generally cylindrical plugs having tapered outside surfaces are fixed to said first and second refrigerator stages.

19. An apparatus according to claim 11 wherein said first and second heat stations are generally cylindrical highly conductive members having internally tapered surfaces tapering negatively in a direction marked from the position of said first cylindrical sleeve.

20. An apparatus according to claim 11 wherein said first and second refrigerator stages and said first and second heat stations make thermal contact when said refrigerator is positioned in said apparatus by means of plugs and heat stations having complimentary mating tapered surfaces fixed to said refrigerator and said apparatus respectively, said plugs and heat stations made from a material of high thermal conductivity.

* * * * *